United States Patent [19]

Cannon

[11] 4,106,665

[45] Aug. 15, 1978

[54] CONTAINER CLOSURE

[75] Inventor: John Porter Cannon, Overland Park, Kans.

[73] Assignee: Plattner Industries, Inc., Ottawa, Kans.

[21] Appl. No.: 794,746

[22] Filed: May 9, 1977

[51] Int. Cl.[2] ..... B65D 43/14; B65D 51/04

[52] U.S. Cl. ..... 220/329; 220/254; 220/336; 220/339; 222/556

[58] Field of Search ..... 220/254, 255, 329, 336, 220/339; 229/7 R; 222/545, 556

[56] References Cited

U.S. PATENT DOCUMENTS

| | | | |
|---|---|---|---|
| 3,169,679 | 2/1965 | Hunter | 220/336 X |
| 3,526,351 | 9/1970 | Goldstein | 220/336 X |
| 3,899,285 | 8/1975 | Christmas | 220/339 X |
| 3,904,074 | 9/1975 | Hoffman et al. | 220/339 |

*Primary Examiner*—George T. Hall

*Attorney, Agent, or Firm*—Schmidt, Johnson, Hovey & Williams

[57] ABSTRACT

A closure for a liquid container has a stopper arm pivotally mounted on the top wall of the container for swinging movement in a plane parallel to the wall toward and away from a position overlying the container outlet. The outlet is provided with locking structure projecting upwardly from the top wall for selectively retaining the arm in closing relationship to the outlet. The arm is capable of being flexed in a plane perpendicular to the top wall permitting up-and-down movement for clearance of the arm-locking structure when the arm is swung to and away from its normal position overlying the outlet.

6 Claims, 3 Drawing Figures

CONTAINER CLOSURE

This invention relates to closures for containers in general and particularly concerns a resealable closure of the type adapted to be attached to a portable food container.

Reusable containers having an attached, resealable closure offer a convenient means for transporting beverages and other foods, and accordingly these containers are widely used by travelers, outdoorsmen, and sports fans. Typically, reusable containers of this type are constructed of a durable, impact-resistant material and have a closure pivotally mounted on the top wall for movement to and form closing relationship over an outlet in the wall of the container.

One problem with the reusable containers described above is a tendency of the closure to jar loose from its outlet-closing position, frequently resulting in undesired spillage of the contents from the container. Moreover, these resealable closures are mounted on their containers in such a manner that manipulation of the container for pouring food through the outlet oftentimes causes the closure to close the outlet prematurely. Of course, such premature closing is undesirable inasmuch as the user must reopen the container and may even be required to awkwardly hold the closure in an open position while pouring from the container.

Likewise, closures of the type comprising a stopper loosely secured to the container by a chain or the like present similar problems when pouring from the container. In this regard, such stoppers simply dangle from the container during pouring, permitting undesired movement of the stopper through the stream of material flowing from the outlet. This results in disruption of the smooth, controlled flow from the outlet and frequently causes annoying splashing and spillage.

Accordingly, it is an important object of the instant invention to provide an arm-like closure which can be easily snapped open by virtue of its flexible nature and then swung laterally from the container outlet to an out-of-the-way position about a fixed pivot on the container where it will not interfere with the pouring action.

It is a further object of the present invention to eliminate undesired premature closing and disruption of flow incident to the use of containers having attached, resealable closures.

It is yet another important object of my invention to provide an improved closure for containers which greatly reduces the likelihood of accidental or unintended opening of the container.

Figure 3:
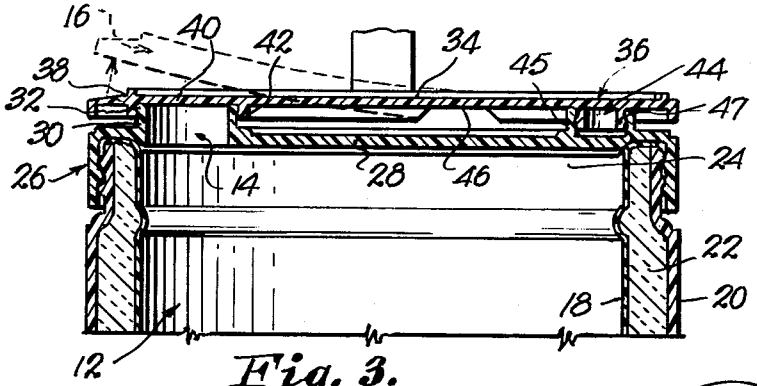
FIG. 3 is a fragmentary, enlarged cross-sectional view taken axially of the container.
Figure 2:
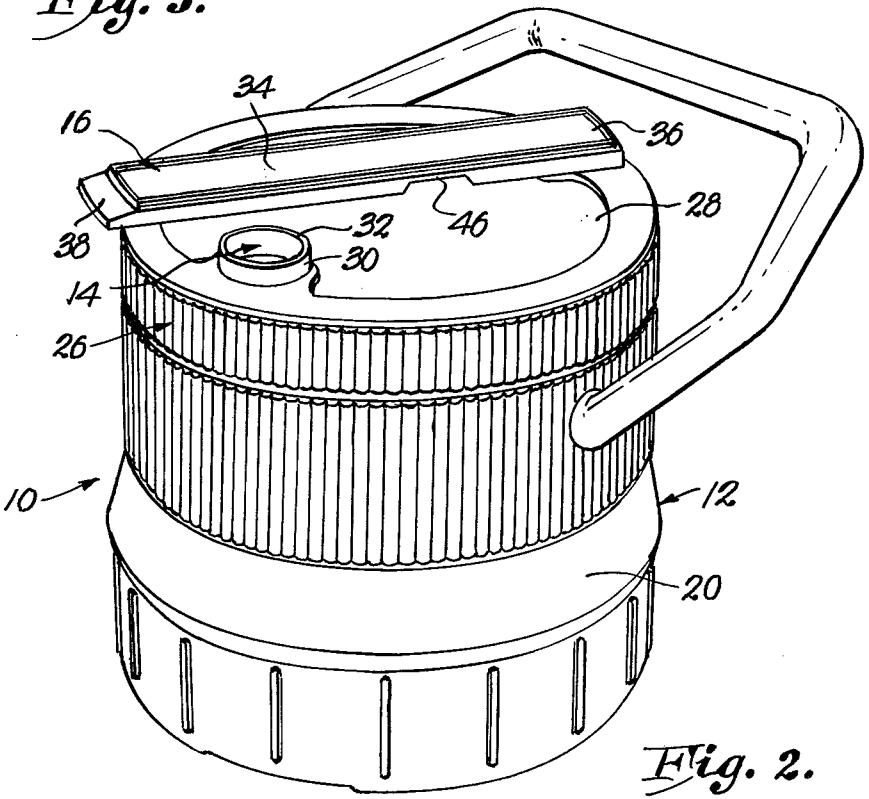
FIG. 2 is a perspective view showing the closure in an open position.
Figure 1:
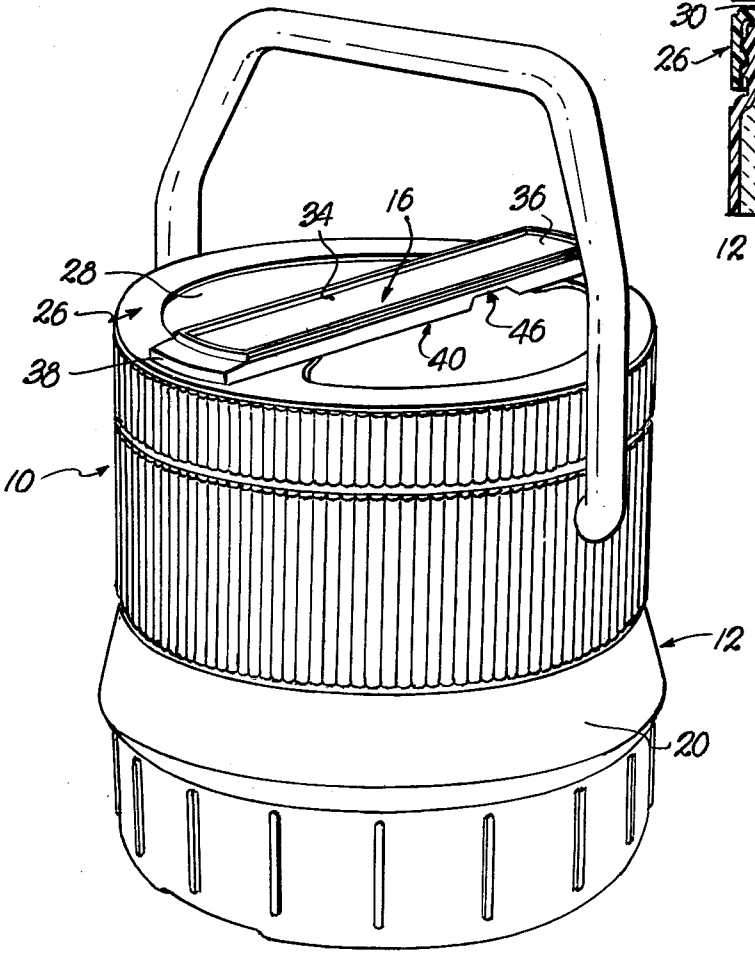
FIG. 1 is a perspective view of a closure constructed in accordance with the principles of my invention and shown operably disposed on a portable container.

A container 10 includes a hollow body 12, an outlet 14 providing a flow path from the body 12, and a closure 16 for selective opening and closing of the outlet 14.

The body 12 is substantially cylindrical, having an inner liner 18, an outer shell 20 surrounding the liner 18, and a layer of insulating foam 22 disposed between the liner 18 and the shell 20. The body 12 has an open end 24 and is provided with a lid 26 threadably engageable with the shell 20 for releasably sealing the open end 24. The lid 26 presents a circular, substantially flat, top wall 28 which is traversed by the closure 16.

The outlet 14 is formed in the wall 28 and is circumscribed by a raised lip 30 which projects upwardly beyond the top surface of the wall 28. A locking rib 32 is integral with and surrounds the lip 30 at the upper edge of the latter in axially aligned relationship thereto for engaging and retaining said arm in an outlet closing position.

The closure 16 comprises an elongate, transversely U-shaped arm 34 having one end 36 pivotally mounted on the wall 28 for swinging movement of the arm 34 in a plane extending parallel to the wall 28. The opposite end 38 of the arm 34 has a stopper 40 for swinging movement with the arm 34 to and from a position overlying the outlet 14.

The stopper 40 includes a female part 42 adapted to receive the lip 30 in seating engagement with the locking rib 32, the latter serving therefore, as a male cooperable with the part 42. In this manner, the stopper 40 functions to selectively open and close the flow path defined by the outlet 14.

The arm 34 is constructed of a resilient material such that, as shown in FIG. 3, the arm 34 may be elastically flexed in a plane extending substantially perpendicularly to the wall 28 for permitting movement of stopper 40 toward and away from locking engagement with the rib 32. It is important to note at this point that the arm 34 is supported on the wall 28 in such manner that its swinging path of travel is traversed by the upwardly projecting lip 30. Hence, in order to bring the stopper 40 into overlying relationship with the outlet 14, it is but necessary to move the arm 34 bidirectionally; that is, the arm must be swung horizontally and flexed upwardly to permit swinging thereof to a position where the stopper 40 overlies the outlet 14. When the stopper 40 is so disposed, the arm 34 remains partially flexed by virtue of contact with the lip 30 and hence, the stopper 40 is yieldably biased toward engagement with the rib 32.

In the preferred embodiment, arm end 36 is provided with a snap-type mount 44 such that the entire arm 34 may be removed from the body 12 for cleaning or other reasons. In order to preclude undesired release of the snap mount 44, the arm 34 has a transversely extending reduced thickness section 46 which isolates the mount 44 from flexure of the arm 34. Mount 44 includes a female portion 45 on the wall 28 and a male portion 47 on the arm 34, the portions 45 and 47 being releasably interlocked.

In use, the body 12 of container 10 is filled with a beverage or other food desired to be stored for later consumption. During the filling operation the lid 26 is normally removed so that the liquid may be easily poured through the open end 24. Once the desired amount of liquid has been poured into the body 12, the lid 26 is replaced on the body 12 to close the open end 24. The stopper 40 is moved to its outlet covering position and manipulated to bring the portion 42 into locking engagement with the rim 30. With the container so arranged, the user may transport the liquid therewithin to any desired location, secure in the knowledge that the stopper 40 is not likely to become disengaged from its outlet-closing position.

When the liquid is to be poured from the container 10, the user simply pulls upwardly on end 38, causing upward bending of the arm 34 and subsequent release of the stopper 40 from its locking engagement with the rim 30. The user then simply swings the arm 34 about its pivotally mounted end 36 to remove the stopper from its outlet covering position, thereby permitting free flow of liquid through the outlet 14 when the body 12 is tilted to a pouring position. During pouring, the raised lip 30 precludes accidental swinging movement of the stopper 40 to its outlet closing position thereby preventing premature closing of the outlet 14. Thus, the user is relieved of the burden of having to hold the stopper 40 away from engagement with the outlet 14 as often required with closures heretofore available.

To close the outlet 14, the user simply lifts end 38, bending arm 34 upwardly, and simultaneously swings the arm 34 horizontally to position the stopper 40 directly over the outlet 14. By then releasing the end 38, the arm 34 returns to a horizontal position thereby moving stopper 40 into its outlet closing position. Slight downward pressure on the end 38 locks the stopper 40 against rib 32 such that the stopper 40 is positively retained in its outlet closing position.

From the foregoing, it is apparent that the present invention offers a simple, yet unique solution to the problems incident to the use of resealable closures as described hereinabove. The closure 16 of the present invention totally eliminates the frustrating problem of premature closing during pouring of liquid from the container 10. Moreover, the unique bidirectional movement required to displace the stopper 40 from its outlet-closing position virtually eliminates accidental disengagement of the stopper 40.

Having thus described the invention, what is claimed as new and desired to be secured by Letters Patent is:

1. A container including:

a generally cylindrical hollow body provided with a circular substantially flat top wall presenting an arcuate periphery;

an outlet in said wall adjacent said periphery;

a closure for said outlet, said closure including an elongate arm having a pair of opposed ends each presenting an arcuate terminal edge, said terminal edges having a curvature substantially identical to the curvature of said periphery, said arm being normally disposed in a first position overlying said outlet and fully traversing said wall diametrically, said edges being aligned with opposed segments of said arcuate periphery when said arm is in said first position, a mount at one end of said arm releasably, pivotally attaching the latter to the wall adjacent said periphery for swinging movement to and from said position within a plane generally parallel with the wall; and releasable means at the opposite end of said arm holding the latter in closing relationship to the outlet when the arm is in said position, said arm being resilient rendering the same capable of being flexed away from said outlet to a second position releasing the arm from the latter prior to swinging the arm about said mount away from the outlet, at least a portion of each of said edges extending beyond said periphery when said arm is swung about said mount away from said outlet, whereby to provide convenient manual engagement of the arm for return of the latter to said first position or for releasing said arm from said mount.

2. The invention of claim 1, said arm being biased toward the outlet for maintaining the latter closed when the arm is in said first position.

3. The invention of claim 2, said releasable means including a lock.

4. The invention of claim 1; and a lip circumscribing the outlet and traversing the path of travel of said arm in said plane for preventing the arm from swinging to said first position during pouring of the contents of the container through the outlet.

5. The invention of claim 1, said arm being transversely U-shaped and having a reduced thickness section adjacent said mount for isolating the latter from flexing movement of the arm.

6. The invention of claim 1, said wall being substantially circular in configuration, said arm normally extending diametrically thereacross.

* * * * *